US005201086A

United States Patent [19]

Decker et al.

[11] Patent Number: 5,201,086

[45] Date of Patent: Apr. 13, 1993

[54] WATER BED SHEET ARRANGEMENT

[76] Inventors: John W. Decker; Sandra M. Decker, both of 4347 Bingham, St. Louis, Mo. 63116

[21] Appl. No.: 905,682

[22] Filed: Jun. 29, 1992

[51] Int. Cl.[5] ..... A47G 9/04

[52] U.S. Cl. ..... 5/451; 5/497; 5/495; 5/925

[58] Field of Search ..... 5/451, 450, 449, 486, 5/482, 497, 495, 496, 498, 925, 499

[56] References Cited

U.S. PATENT DOCUMENTS

| | | | |
|---|---|---|---|
| 2,689,961 | 9/1954 | Lieberthal | 5/486 |
| 2,695,414 | 11/1954 | Ford et al. | 5/497 |
| 2,730,728 | 1/1956 | Roberts | 5/486 |
| 3,072,776 | 1/1963 | Quenneville | 5/486 |
| 4,214,327 | 7/1980 | Smith | 5/504.1 |
| 4,736,478 | 4/1988 | Dangerously | 5/497 |
| 4,802,251 | 2/1989 | O'Dell | 5/486 |
| 4,809,376 | 3/1989 | Boldra | 5/497 |
| 5,029,353 | 7/1991 | Kimball et al. | 5/497 |

*Primary Examiner*—Alexander Grosz
*Attorney, Agent, or Firm*—Leon Gilden

[57] ABSTRACT

A water bed sheet structure is arranged to accommodate extended configuration sizes of water bed mattresses, wherein the sheet structure includes overlapping at first ends of first and second sheets selectively securable together utilizing an elongate row of fastener structure.

1 Claim, 4 Drawing Sheets

WATER BED SHEET ARRANGEMENT

BACKGROUND OF THE INVENTION

1. Field of the Invention

The field of invention relates to water bed and mattress sheet structure, and more particularly pertains to a new and improved water bed sheet arrangement to accommodate extended sizes of water bed mattresses.

2. Description of the Prior Art

Water bed mattresses due to sizes typically larger than conventional mattress configurations have heretofore not accommodate conventional sheet structures in a reasonable manner for the enjoyment of a plurality of individuals utilizing larger water bed mattress sizes such as the king and queen type sizes. Various bed sheet constructions have been available in the prior art as exemplified in U.S. Pat. Nos. 4,964,184; 4,802,251; 4,912,790; and 4,777,894.

Such prior art construction has heretofore failed to provide for accommodating of mattress sizes of water beds that are of extended configurations while attempting to utilize conventional bed sheet structure, wherein the instant invention addresses such deficiencies by employing a plurality of sheets arranged for securement together to accommodate enlarged water bed mattress sizes and configurations and in this respect, the present invention substantially fulfills this need.

SUMMARY OF THE INVENTION

In view of the foregoing disadvantages inherent in the known types of mattress and bed sheet constructions now present in the prior art, the present invention provides a water bed sheet arrangement wherein the same is addressed to accommodate enlarged size structure of water bed type mattresses. As such, the general purpose of the present invention, which will be described subsequently in greater detail, is to provide a new and improved water bed sheet arrangement which has all the advantages of the prior art sheet construction and none of the disadvantages.

To attain this, the present invention provides a water bed sheet structure arranged to accommodate extended configuration sizes of water bed mattresses, wherein the sheet structure includes overlapping at first ends of first and second sheets selectively securable together utilizing an elongate row of fastener structure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved water bed sheet arrangement which has all the advantages of the prior art sheet construction and none of the disadvantages.

It is another object of the present invention to provide a new and improved water bed sheet arrangement which may be easily and efficiently manufactured and marketed.

It is a further object of the present invention to provide a new and improved water bed sheet arrangement which is of a durable and reliable construction.

An even further object of the present invention is to provide a new and improved water bed sheet arrangement which is susceptible of a low cost of manufacture with regard to both materials and labor, and which accordingly is then susceptible of low prices of sale to the consuming public, thereby making such water bed sheet arrangements economically available to the buying public.

Still yet another object of the present invention is to provide a new and improved water bed sheet arrangement which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
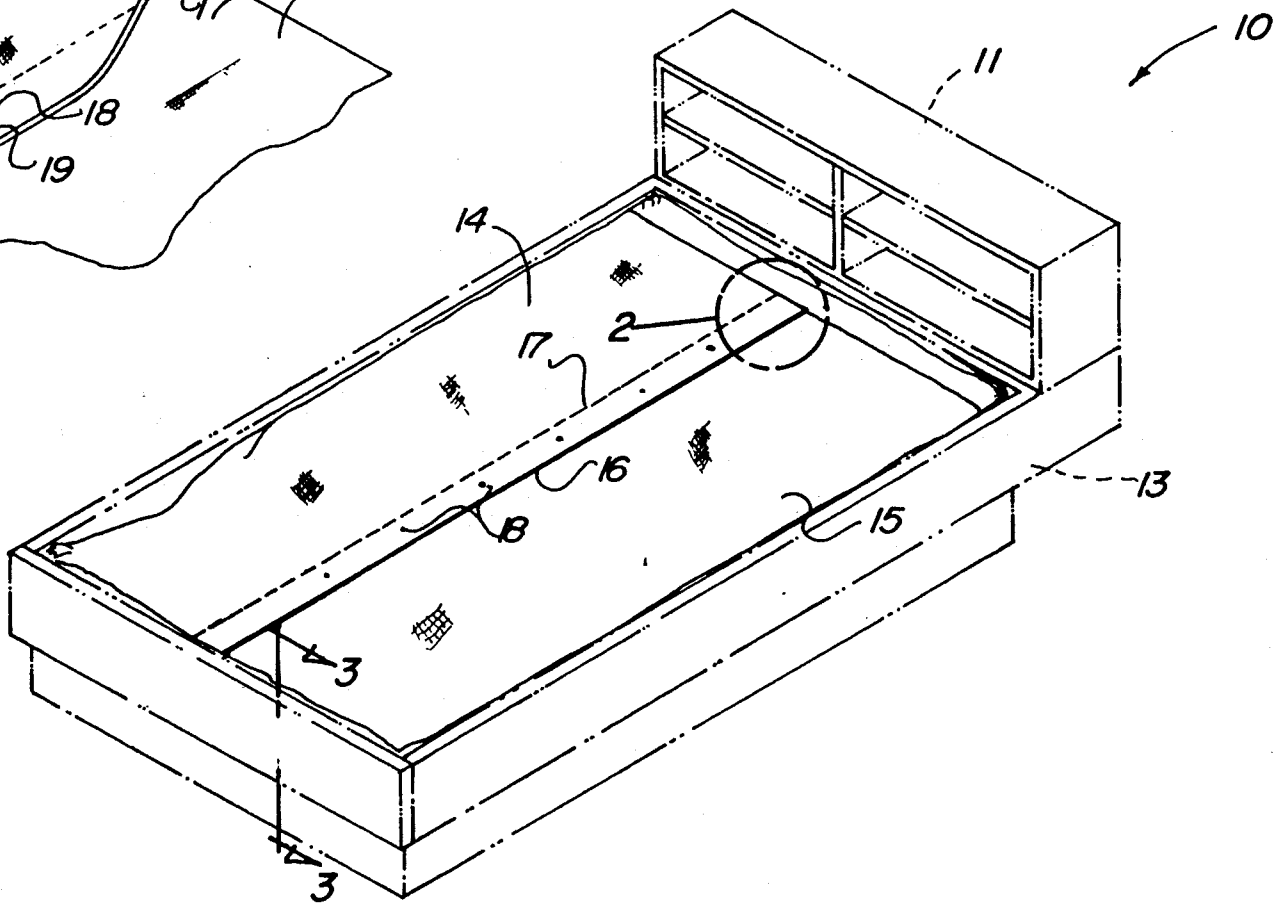
FIG. 1 is an isometric illustration of the instant invention.
Figure 2:
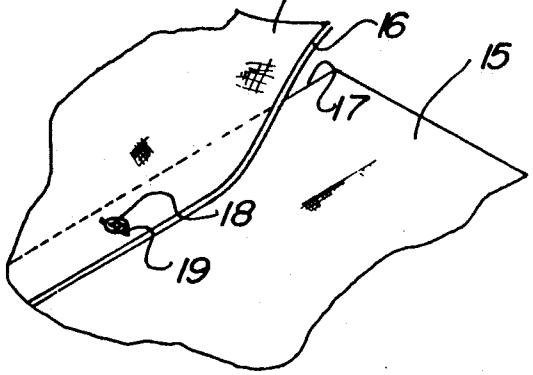
FIG. 2 is an isometric illustration of section 2 as set forth in FIG. 1.
Figure 3:
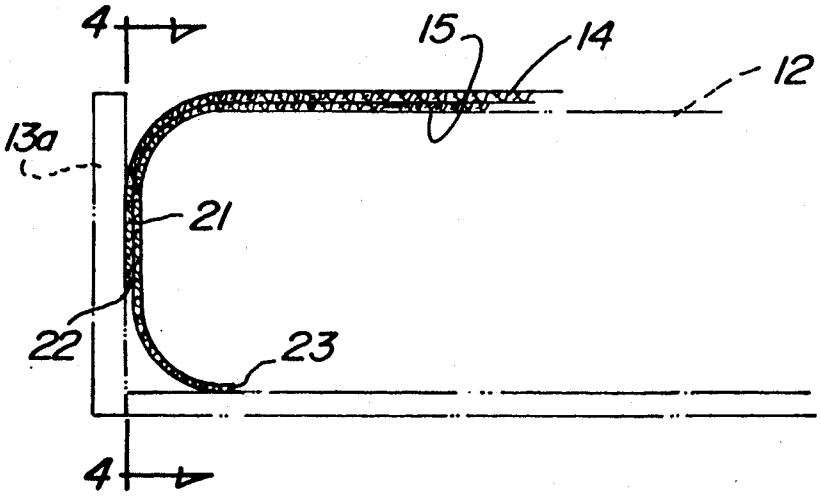
FIG. 3 is an orthographic view, taken along the lines 3—3 of FIG. 1 in the direction indicated by the arrows.
Figure 4:
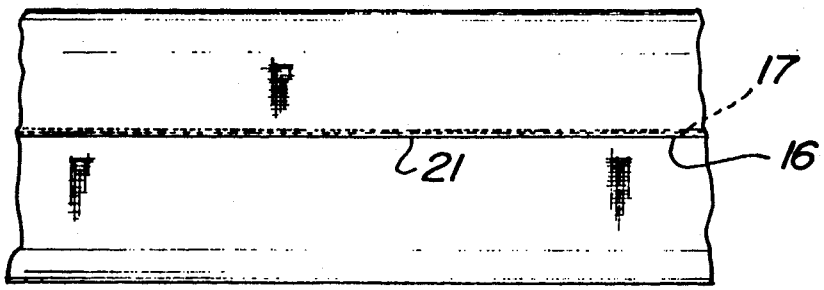
FIG. 4 is an orthographic view, taken along the lines 4—4 of FIG. 3 in the direction indicated by the arrows.

With reference now to the drawings, and in particular to FIGS. 1 to 10 thereof, a new and improved water bed sheet arrangement embodying the principles and concepts of the present invention and generally designated by the reference numeral 10 will be described.

More specifically, the water bed sheet arrangement 10 of the instant invention essentially comprises positioning within a water bed 11 having a water bed mattress 12 of fluid filled construction. The mattress 12 is mounted within a container frame 13 having frame side walls and a container frame foot board 13*a*. A first sheet member 14 and a second sheet member 15 are arranged coextensively relative to one another positioned to a top surface of the mattress 12. The first sheet member and the second sheet member 14 and 15 respectively include respective first and second sheet member first side edges 16 and 17 that overlap in a parallel relationship, as illustrated in the FIGS. 1 and 2 for example. A row of button members 18 is mounted to the second sheet 15 adjacent the second sheet first side edge 17 received through button receiving slots 19 directed through the first sheet 14 adjacent the first sheet members first side edge 16 to permit selective securement of the first and second sheets together.

Optionally, a lower seam 21 is directed along the overlap of the first and second side edges 16 and 17 extending from a first sheet lower edge 22 and a second sheet lower edge 23 that in turn is positioned below the mattress 12 to permit securement of the sheet structure relative to the mattress structure.

Figure 6:
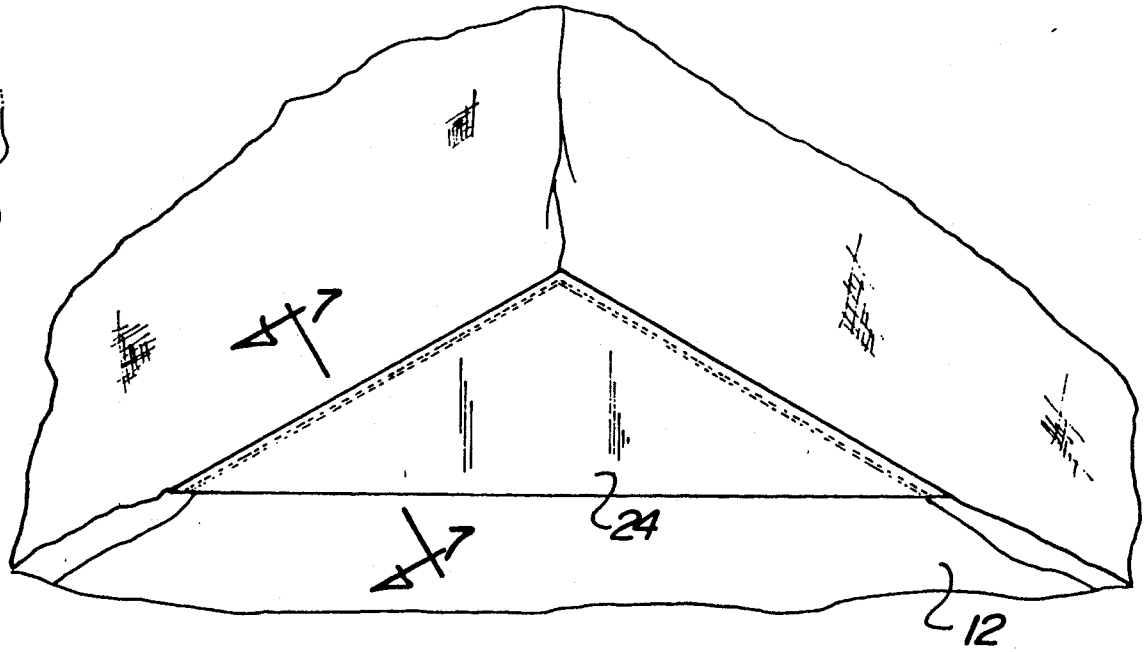
FIG. 6 is an orthographic view, taken along the lines 6—6 of FIG. 5 in the direction indicated by the arrows.
Figure 5:
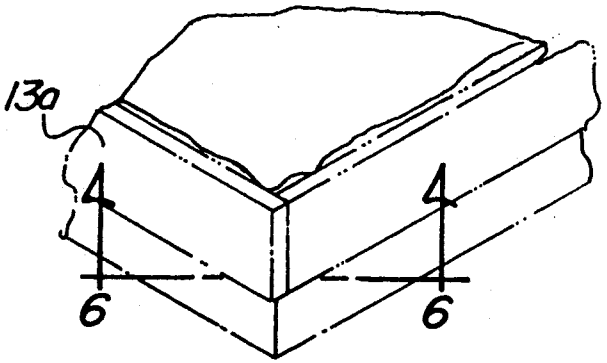
FIG. 5 is an isometric illustration of a corner section of a water bed mattress and the sheet structure of the invention.
Figure 7:
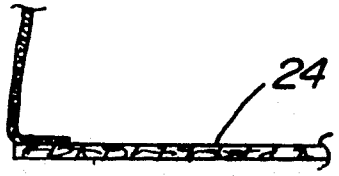
FIG. 7 is an orthographic view, taken along the lines 7—7 of FIG. 6 in the direction indicated by the arrows.
Figure 10:
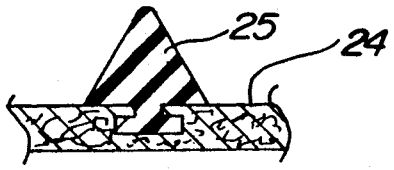
FIG. 10 is an orthographic view, taken along the lines 10—10 of FIG. 9 in the direction indicated by the arrows.
Figure 8:
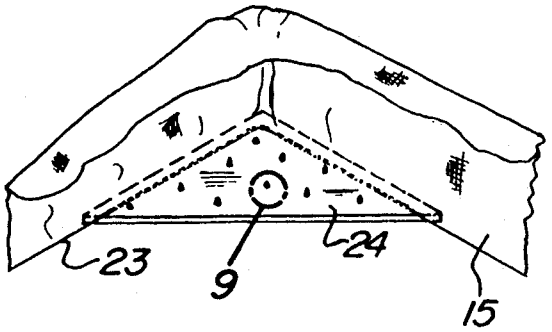
FIG. 8 is an isometric bottom view of the invention employing corner plate structure having engagement projections mounted thereon.
Figure 9:
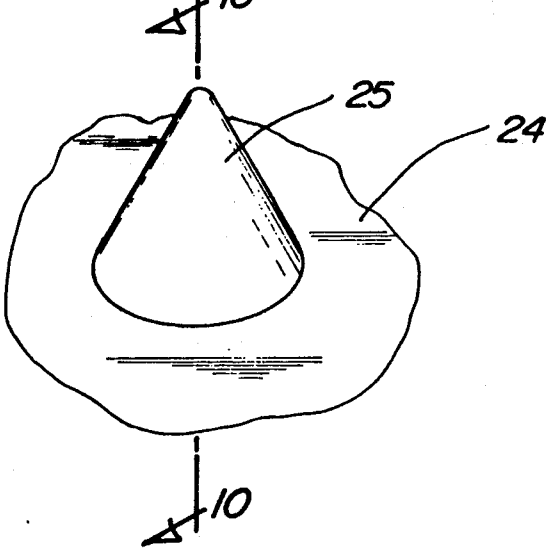
FIG. 9 is an isometric illustration of section 9 as set forth in FIG. 8.

As illustrated in the FIGS. 6 and 7, a flexible corner plate 24 is positioned below the mattress 12 at corners of the mattress adjacent the foot board 13*a*. The corner plate 24 is mounted to secure the second side edges relative to the lower edges of the sheets adjacent the foot board for positioning under the mattress to provide for proper orientation of the sheets mounted to the mattress structure. FIGS. 8–10 illustrate that each of the corner plates 24 (for purposes of illustration, only one such corner plate is illustrated but it is understood that the identical construction is arranged for securement to the first sheet member 14) includes a matrix of conical resilient projections 25 extending into communication with a bottom surface of the mattress 12 to enhance positioning of the corner plates to minimize displacement of the corner plates relative to the associated mattress structure.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A water bed sheet arrangement, comprising, a water bed having a water bed container frame, and a mattress contained within the container frame, the container frame including container frame side walls and a container frame foot board directed coextensively between the side walls, and the mattress including a mattress top surface and a mattress bottom surface, and a first sheet member and a second sheet member, the first sheet member and the second sheet member including a first sheet member first side edge and a second sheet member second side edge positioned in adjacency in a parallel relationship relative to one another in an overlapped configuration onto a top surface of the mattress, and the second sheet member includes a row of button members mounted to the second sheet member adjacent the second sheet member first side edge, the first sheet member including a like plurality of button member receiving slots for receiving the button members, wherein the button member receiving slots are directed through the first sheet member adjacent the first sheet member first side edge, and the first sheet member and the second sheet member are joined at the first side edge and second side edge to include a lower seam directed along the foot board, and the first sheet member includes a first sheet member second side edge spaced from the first sheet member first side edge, and a second sheet member second side edge spaced from the second sheet member first side edge, and the first sheet member second side edge includes a flexible corner plate positioned adjacent the foot board, and the second sheet member second side edge includes a further corner plate positioned adjacent the foot board, and each corner plate is of flexible construction and including a matrix of resilient conical tips mounted to the corner plate in communication with the mattress bottom surface.

* * * * *